US006919789B2

(12) United States Patent
Lin

(10) Patent No.: US 6,919,789 B2
(45) Date of Patent: Jul. 19, 2005

(54) CONNECTING STRUCTURE OF CHOKE COIL

(75) Inventor: Kuo-Liang Lin, Chia-Yi Hsien (TW)

(73) Assignee: SZ Fong Electronics Co., LTD (TW)

( * ) Notice: Subject to any disclaimer, the term of this patent is extended or adjusted under 35 U.S.C. 154(b) by 113 days.

(21) Appl. No.: 10/388,515

(22) Filed: Mar. 17, 2003

(65) Prior Publication Data

US 2004/0183641 A1 Sep. 23, 2004

(51) Int. Cl.[7] ..... H01F 27/30
(52) U.S. Cl. ..... 336/198; 336/61; 336/212; 336/219
(58) Field of Search ..... 336/198, 65, 192, 336/209, 212, 213, 61, 182, 184, 219

(56) References Cited

U.S. PATENT DOCUMENTS 6,480,088 B2 * 11/2002 Okamoto ..... 336/229
6,600,402 B1 * 7/2003 LaFleur et al. ..... 336/61

* cited by examiner

*Primary Examiner*—Lincoln Donovan
*Assistant Examiner*—Jennifer A. Poker
(74) *Attorney, Agent, or Firm*—Birch, Stewart, Kolasch & Birch, LLP

(57) ABSTRACT

A connecting structure of choke coil, comprises a coil base composed of two halves forming an accommodating area within the two halves, and a coiling area beyond the two halves, and a corresponding symmetric connecting section extended from a solid section each on both sides of the coiling area, such that the coil base is installed onto a housing and constitutes an insulation with the housing to prevent a high-voltage electric leakage and comply with the requirements of high-voltage electric leakage tests.

13 Claims, 7 Drawing Sheets

CONNECTING STRUCTURE OF CHOKE COIL

FIELD OF THE INVENTION

The present invention relates to an improved connecting structure of a choke coil, more particularly to a coil socket structure being installed on the housing of an electric appliance and forming an insulation with the housing to prevent a high-voltage electric leakage and comply with a high-voltage electric leakage test.

BACKGROUND OF THE INVENTION

At present, various choke coils are used in electric appliances of different functions. Therefore, the choke coil plays an important role in the power supply of each electric appliance. Such choke coil improves the percentage of use of the energy source, and reduces unnecessary power consumption of the electric power system. Besides attaining the requirement of extending the life of electric appliance products, the choke coil in accordance with this invention also has effects on environmental protection. Therefore the choke coil becomes a necessary and easy-to-use component for electric appliance products.

At present, metal packages are generally used to pack the silicon steel plate of transformers or choke coils, and such package is composed of a housing and a base. After such package is installed to a transformer or a choke coil, the transformer or choke coil can be installed onto the metal housing of each electric appliance.

Since the metal housing design has to ground the electric appliance, therefore after the package of choke coil is installed onto the housing, it will have a short circuit. Once the coil and the package get into a secondary manufacture and assembly and the assembler is not careful enough to let the plastic tape (or insulating layer) wrapped on the coil crack, the silicon steel plate will be in contact with the coil. If the choke coil produces a high-voltage electric leakage during its use, it may affect the normal operation or damage the adjacent component, and cause failure to the electric appliance or even endanger the user.

Further, it is difficult for a user to assemble a traditional transformer, because the distance from the connecting section is too short and too close to the silicon steel plate. The user has to use one hand to install a screw into a hole on the connecting section from the exterior of the housing, and the other hand to hold the nut for the connection. Such arrangement may scratch the silicon steel plate if the assembling is not done with care. Furthermore, since the size of screw nuts and screws is small, users often drop them inside the housing, which may cause accidents such as a short circuit to the electric appliance. In addition, the support to the connecting section extended from both sides of the solid section is not enough, and they will break or crack due to the overload, particularly in the situation when the electric appliance produces vibrates during its operation.

SUMMARY OF THE INVENTION

The primary objective of the present invention is to overcome the above shortcomings of the traditional method and avoid the above deficiencies. The present invention uses a connecting structure to let the coil be installed to the housing of an electric appliance and form an insulation to prevent a high-voltage electric leakage and comply with a high-voltage electric leaking test. The present invention makes the manufacture much easier, simpler, and timesaving as well as greatly lowers the manufacturing cost.

Another objective of the present invention is to let assemblers quickly and easily secure the transformer onto the housing of the electric appliance.

To achieve the above objectives, the connecting structure of the present invention comprises a coil base composed of two halves; an accommodating area formed within the two halves; a coiling area outside the two halves; a corresponding symmetric connecting section extended from a solid section each on both sides of said coiling area; and a hole disposed on said connecting section.

BRIEF DESCRIPTION OF THE DRAWINGS

To provide a further understanding of the invention, the following detailed description illustrates embodiments and examples of the invention, this detailed description being provided only for illustration of the invention.

DETAILED DESCRIPTION OF THE PREFERRED EMBODIMENTS

Figure 1:
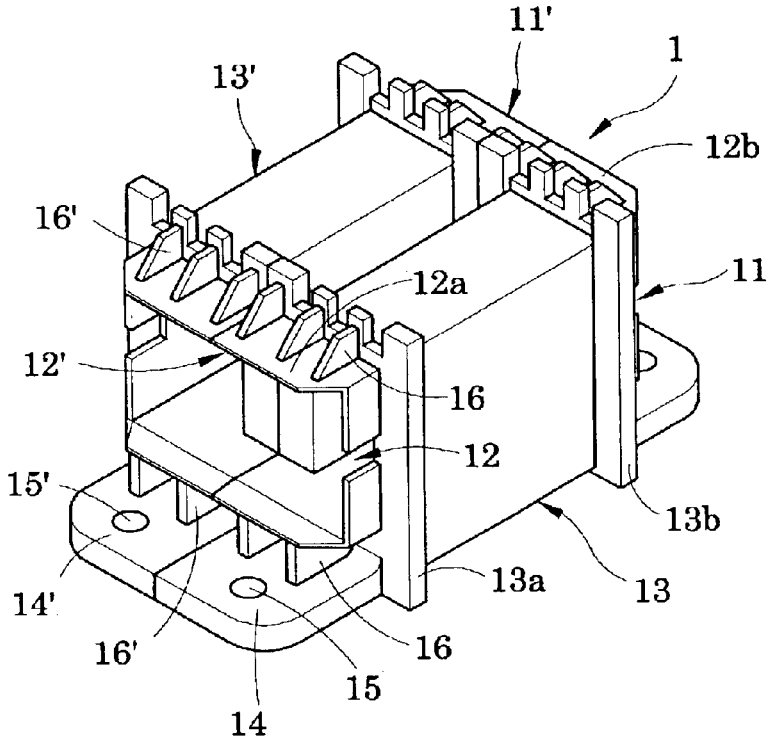
FIG. 1 is a perspective diagram of the connecting structure of a choke coil according to the present invention.
Figure 2:
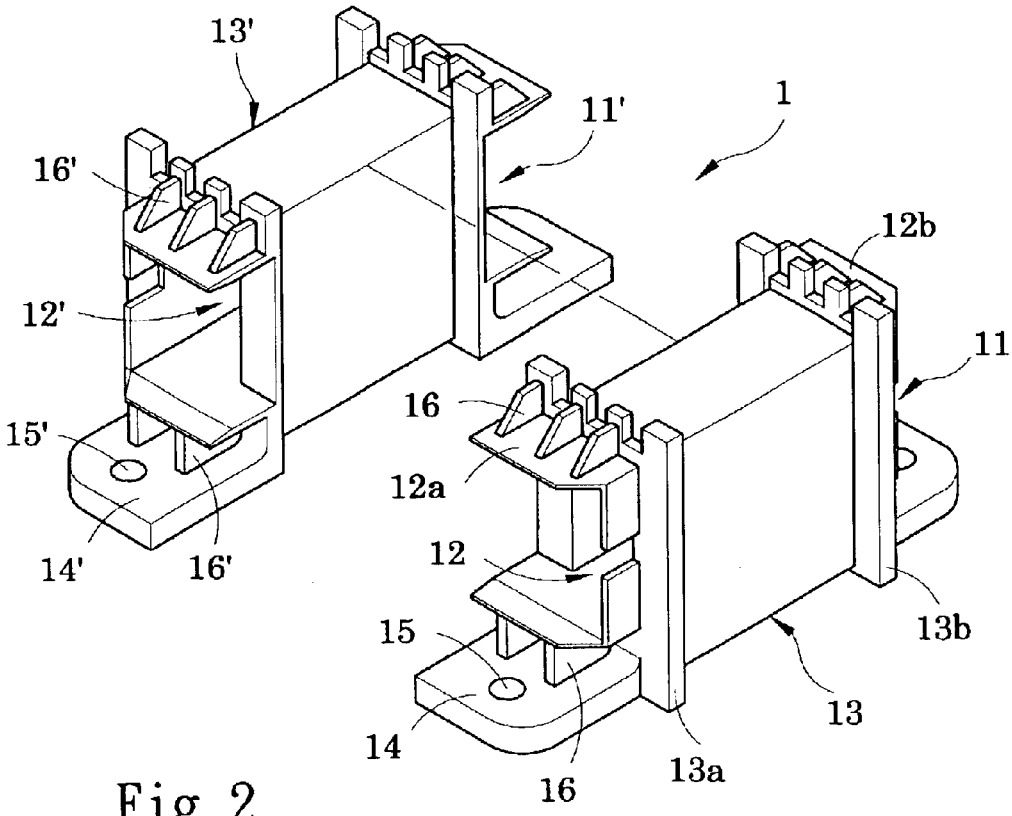
FIG. 2 is a perspective diagram of the disassembled parts of the present invention.

Please refer to FIGS. 1 and 2 for the perspective diagram of the present invention and the illustrative diagram of the disassembled parts of the structure according to the present invention respectively.

In the figures, the improved connecting structure of a choke coil according to the present invention, comprises a coil base 1 for coiling a coil (not shown in the figure) and connecting to a silicon steel plate (not shown in the figure); said coil base 1 is made of plastic material and integrally formed by plastic injection. When the coil base 1 is installed onto a housing (not shown in the figure) of an electric appliance, the present invention can prevent high-voltage electric leakage and comply with the requirements of high-voltage electric leakage tests.

Said coil base 1 is composed of two halves 11, 11', and a silicon steel plate (not shown in the figure) placed in an accommodating area 12, 12' in each half 11, 11', and an coiling area 13, 13' disposed outside, a pair of symmetric connecting sections 14, 14' being extended from a solid area 13*a*, 13*b* on both sides of said coiling area 13, 13', and a hole 15, 15' secured on the coil base 1 for letting a coupling member (not shown in the figure) on said connecting section 14, 14' pass through and secure the coil base onto the electric appliance; further, a reinforced rib 16, 16' is connected between the solid sections 13*a*, 13*b* on both sides of the coiling area 13, the solid sections 12*a*, 12*b* on both sides of the accommodating area 12, and the connecting section 14 for reinforcing the stress of the solid sections 12*a*, 12*b*. Such arrangement provides a coil base that can prevent a high-voltage electric leakage and comply with the requirements of high-voltage electric leakage tests.

Figure 3:
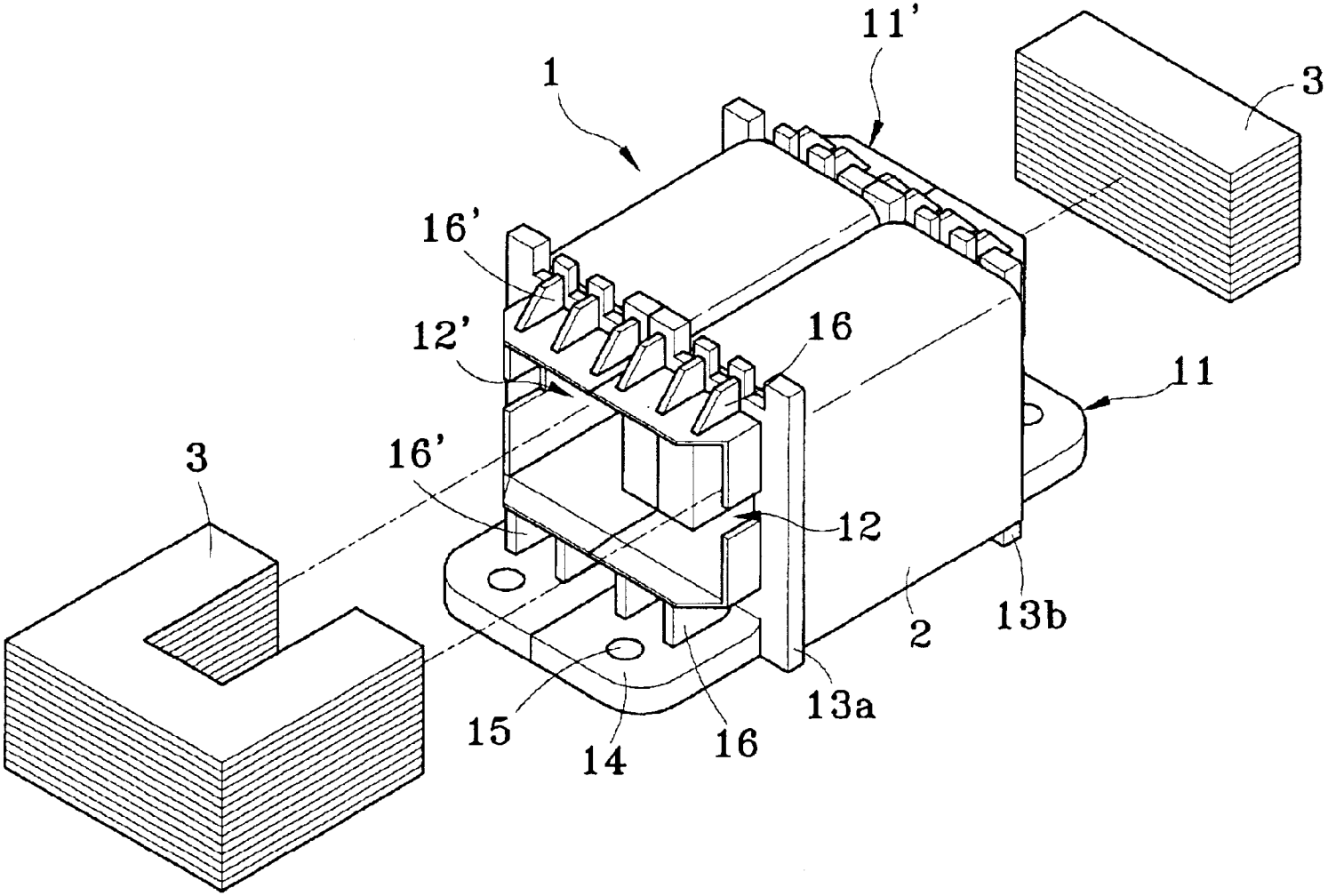
FIG. 3 is an illustrative diagram of the using status of the present invention.

Please refer to FIG. 3 for the illustrative diagram of the using status of the present invention. When the choke coil is manufactured, the coiling areas 13, 13' of both halves 11, 11' of the coil base 1 are coiled with a coil 2, and then an insulating tape is stuck on the surface of the coil 2. After the coil 2 is coiled around the two halves 11, 11', both ends of the coil 2 extended to the outside are connected. Then the two halves 11, 11' are also connected. A silicon steel plate 3 is coupled to the accommodating areas 12, 12' of the two halves 11, 11' to let both halves 11, 11' be coupled with each other. It then completes the process of manufacturing a choke coil.

Figure 4:
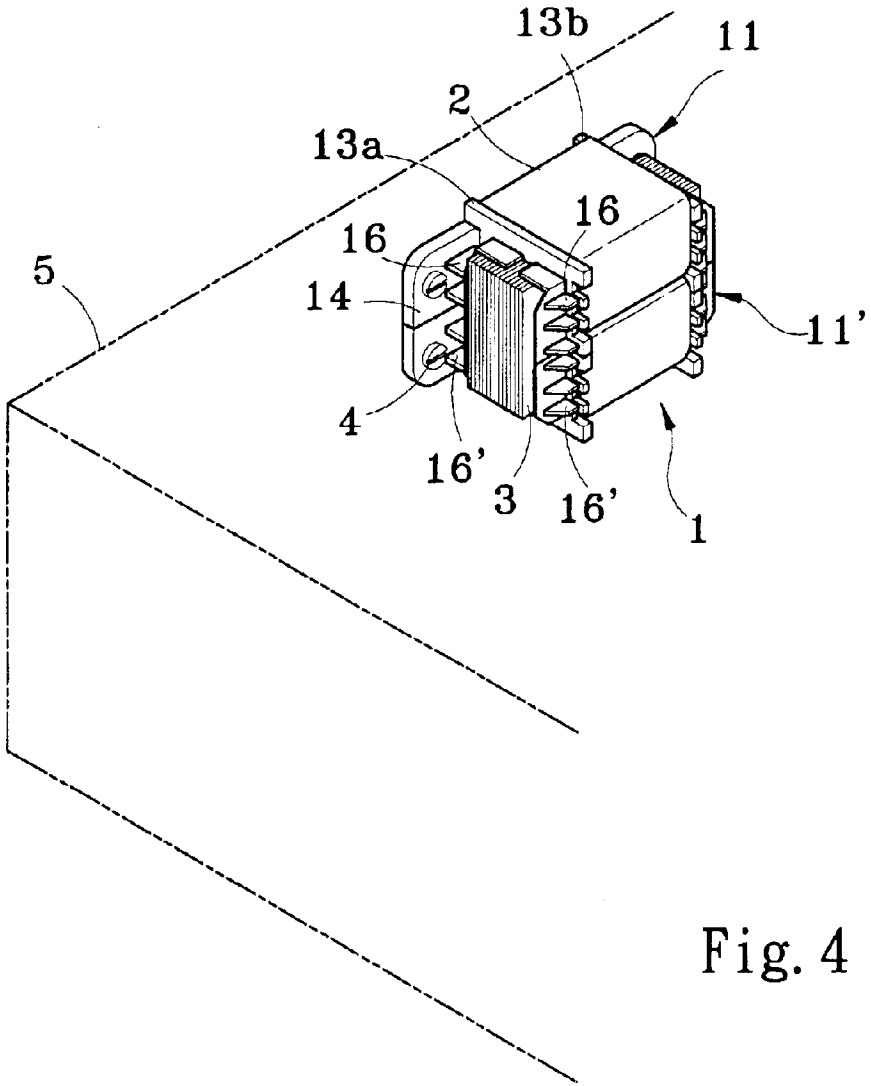
FIG. 4 is another illustrative diagram of the using status of the present invention.

Please refer to FIG. 4 for the illustrative diagram of another using status of the present invention. As shown in the figure, the hole 15, 15' on the coil base 1 can be used for letting the coupling member pass through and secure the coil base 1 onto the housing 5 of an electric appliance when the manufactured choke coil is in use.

Figure 5:
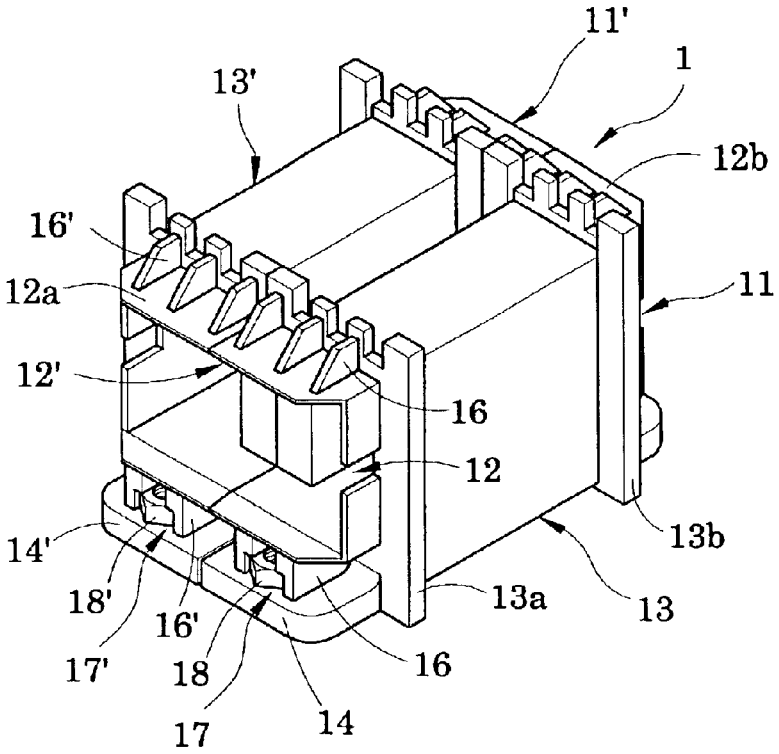
FIG. 5 is an illustrative diagram of another embodiment of the present invention.
Figure 6:
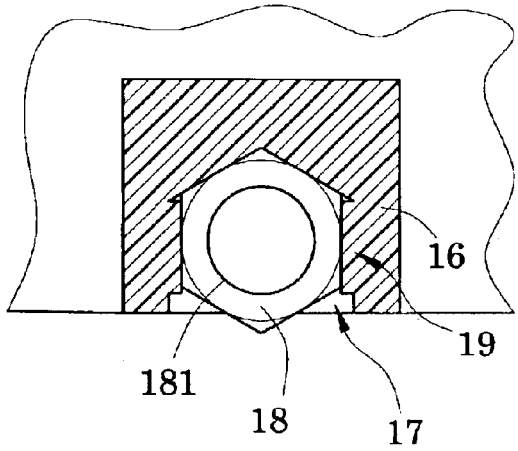
FIG. 6 is a cross-sectional diagram of part of the coupling member as shown in FIG. 5.

Please refer to FIGS. 5 and 6 for another embodiment and the illustrative cross-sectional diagram of part of the coupling member as shown in FIG. 5. In the figures, the structure of the coil base 1 of this embodiment is basically the same as the aforementioned coil base 1, and their only difference lies on that a connecting area 17, 17' is added to the reinforced ribs 16, 16' between the accommodating area 12, 12' and the coupling section 14, 14'. Such connecting, area 17, 17' comprises a polygonal coupling member 18, 18' and a threaded coupling section 181, 181' in the coupling member 18, 18'. A protrusion 19 is disposed in each connecting area 17, 17', and such protrusion 19 allows the coupling member 18, 18' to be tightly embedded into the connecting area 17, 17'. In the coupling process, the coupling member will not get loose or rotate as the movable component (not shown in the figure) rotates, and thus facilitating assemblers to install the coil base 1 onto the housing of an electric appliance.

Figure 7:
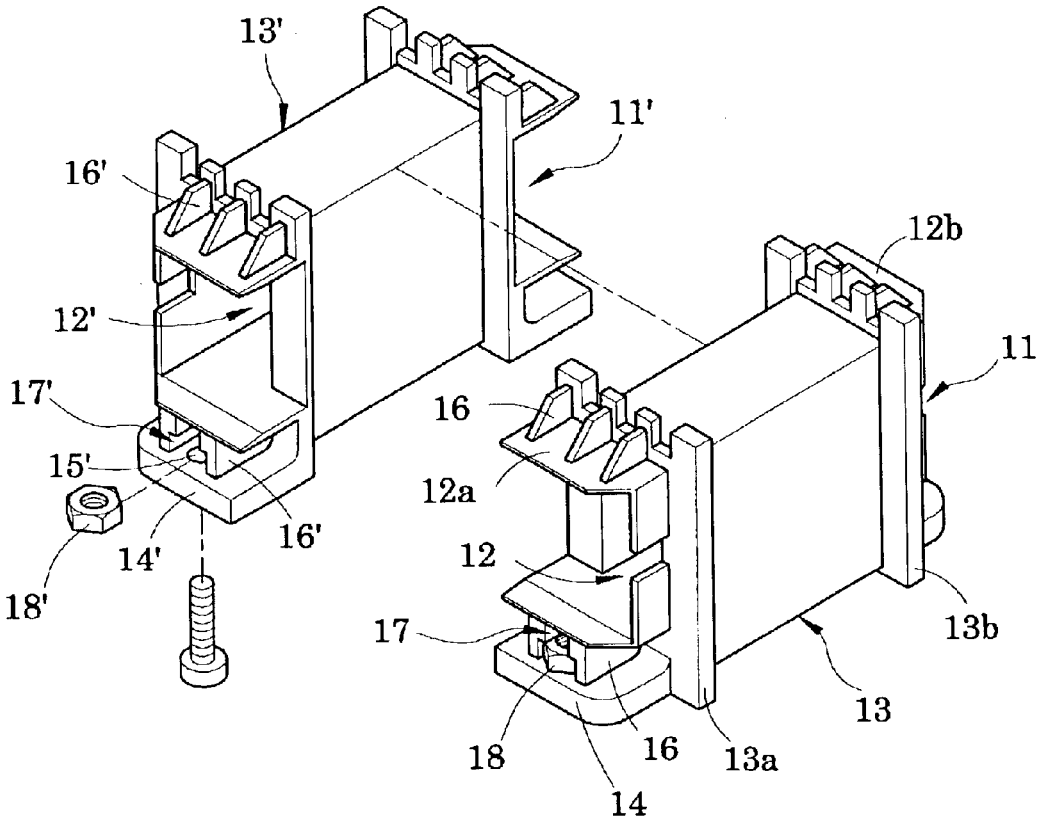
FIG. 7 is an illustrative diagram of the using status of the connecting structure as shown in FIG. 5.

Please refer to FIG. 7 for an illustrative diagram of the using status as shown in FIG. 5. As shown in the figure, when the coil base 1 is installed onto the housing (not shown in the figure) of an electric appliance, a movable component 6 having a threaded external surface is used to pass through the housing and directly coupled to the coupling section 181, 181' of the coupling member 18, 18'. While the movable component 6 rotates and couples, the protrusion 19 restricts the coupling member 18, 18' to rotates according to the movable component 6, so that the assembler can easily secure the coil base 1 onto the housing.

Figure 8:
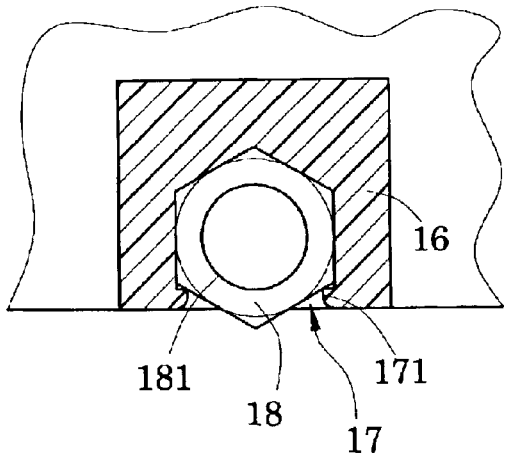
FIG. 8 is another illustrative diagram of the using status of the present invention.

Please refer to FIG. 8 for the illustrative diagram of another embodiment according to FIG. 5. In the figure, this embodiment adds a blocking section 171 at both ends of the opening of the foregoing connecting area 17, 17'; when the coupling member 18, 18' is installed into the connecting area 17, 17', the blocking area 171, 171' keeps the coupling member 18, 18' from being separated from the interior of the connecting area 17, 17' and secured in the connecting area 17, 17'.

Figure 9:
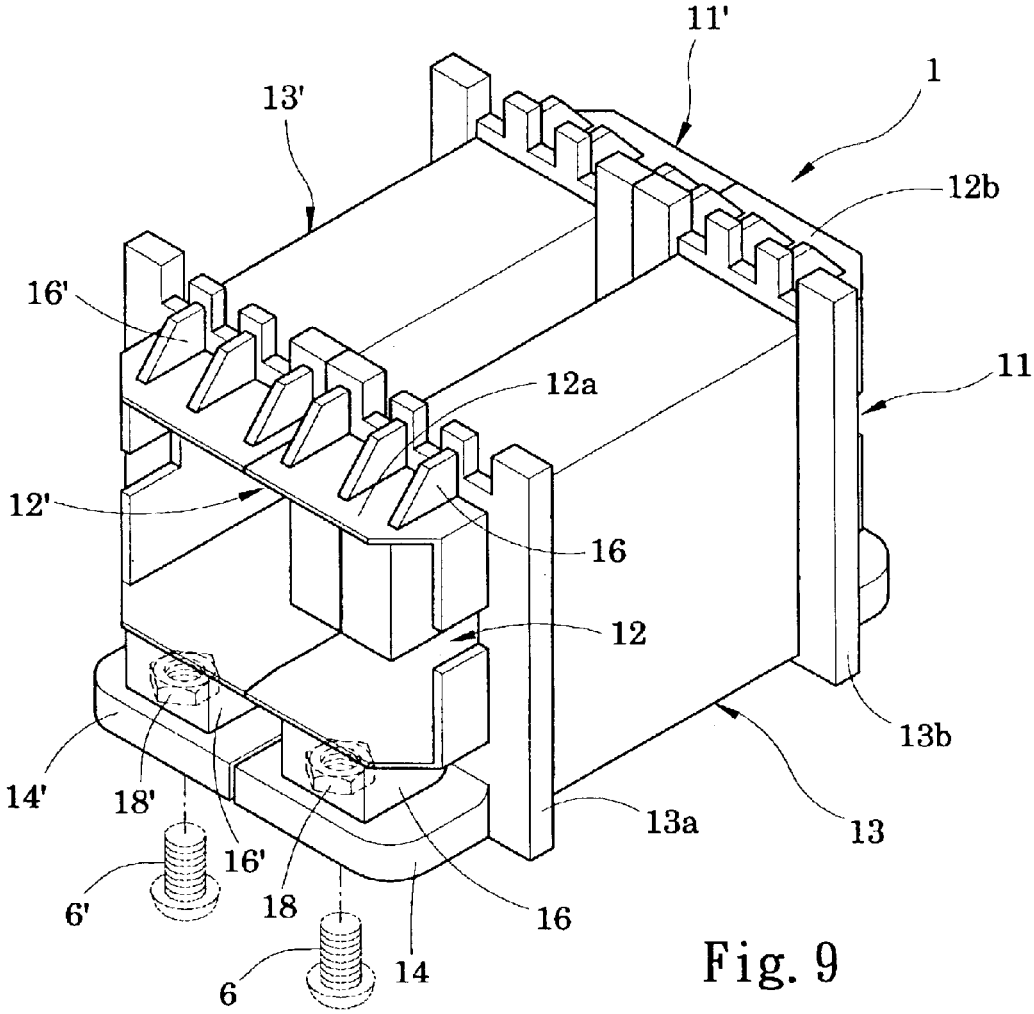
FIG. 9 is an illustrative diagram of another embodiment of the present invention.
Figure 10:
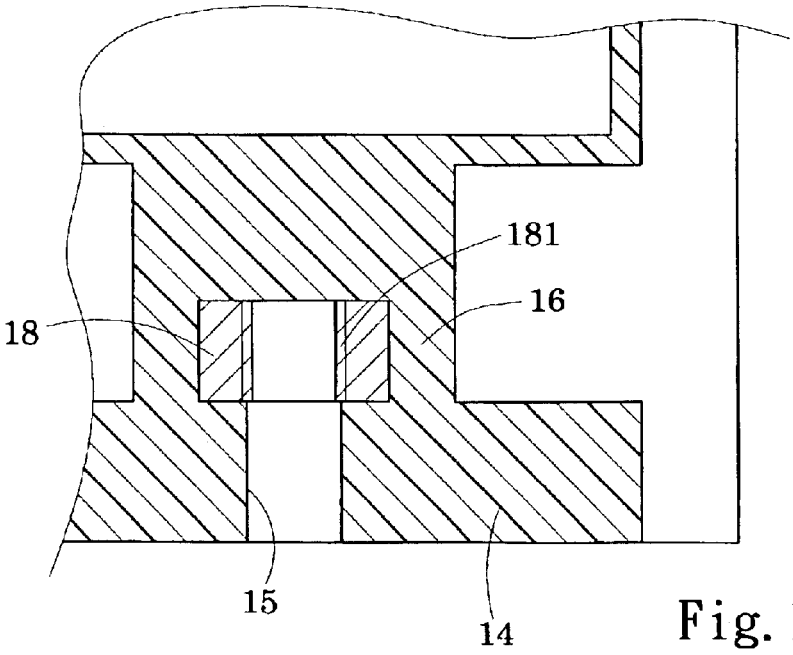
FIG. 10 is a cross-sectional diagram of part of the coupling member as shown in FIG. 9.

Please refer to FIGS. 9 and 10 for another embodiment and an illustrative cross-sectional diagram of part of the coupling member according to FIG. 9. In the figure, this embodiment is basically the same as the embodiment previously shown in FIG. 5, and the difference lies on that before the coil base 1 is injected for formation, the coupling members 18, 18' are placed into a mold (not shown in the figure) first, and the coupling members 18, 18' are wrapped into the reinforced ribs 16, 16' of the coil base 1 and integrally coupled with the coil base 1, and thus making the manufacture much easier and faster.

Figure 11:
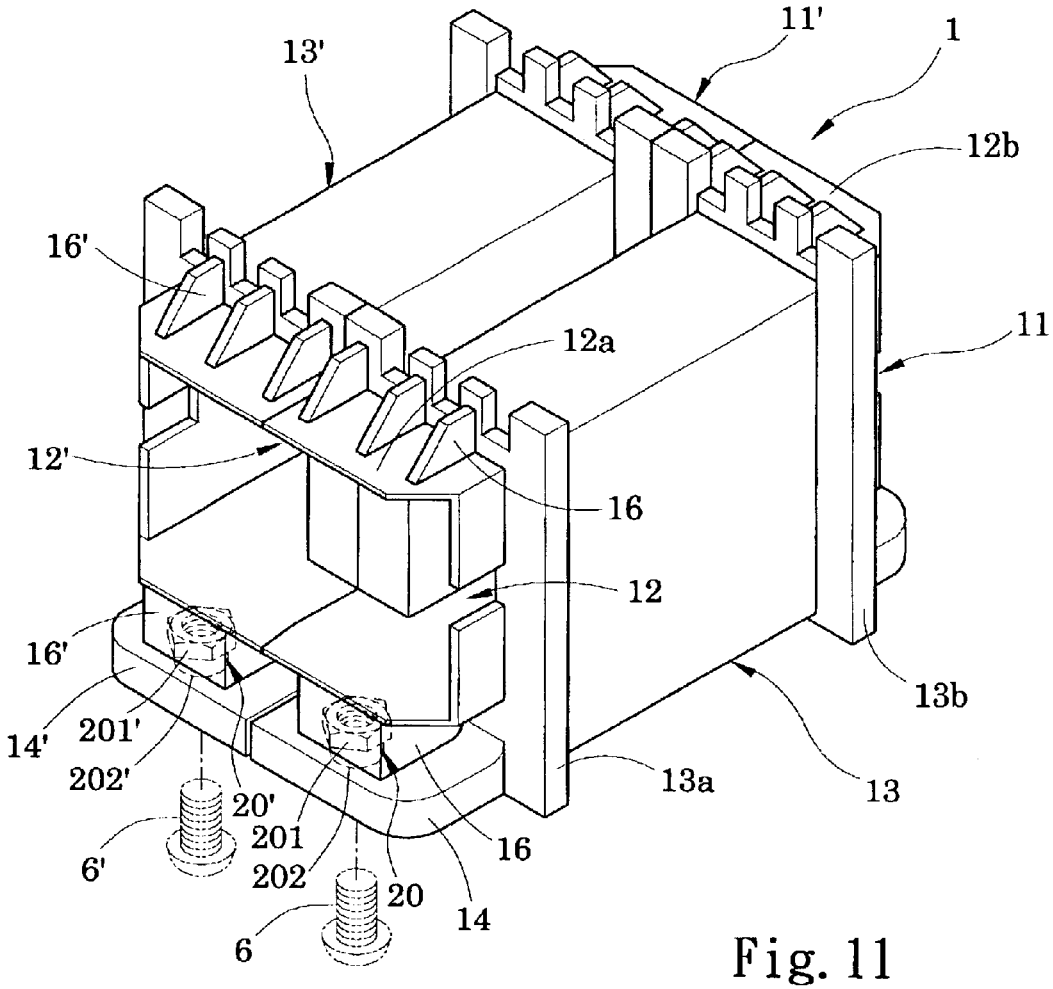
FIG. 11 is an illustrative diagram of another embodiment of the present invention.
Figure 12:
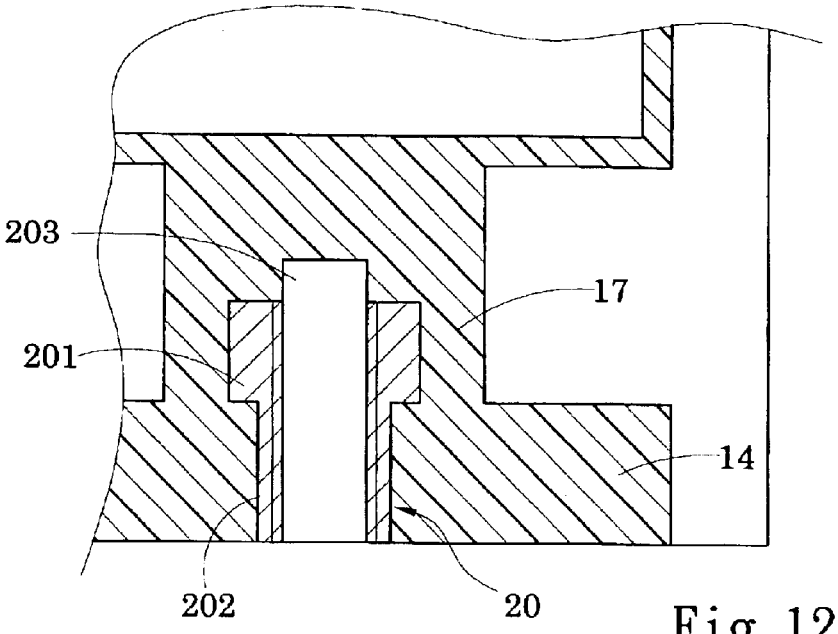
FIG. 12 is a cross-sectional diagram of part of the coupling member as shown in FIG. 11.

Please refer to FIGS. 11 and 12 for another embodiment of the present invention and the illustrative cross-sectional diagram of the coupling member according to FIG. 11. In the figures, this embodiment is basically the same as the one previously shown in FIG. 10, and the difference lies on that the coupling member 20 comprises a restricting section 201 and a coupling section 202, and both restricting section 201 and coupling section 202 have threads on their inner edges to facilitate the connection of the coupling member 20. The circumference of the restricting section 201 is larger than the circumference of the coupling section 202, and thus can prevent the coupling member 20 from falling out of the coil base 1. In addition, since both restricting section 201 and coupling section 202 have threads, therefore they provide a longer length for coupling the movable component 6 and assuring the, stability. A buffer area 203 disposed on the restricting section 201 corresponsive to the solid section of the reinforced rib 16, 16' is coupled according to different lengths of the movable component 6.

Further, the coil base 1 and the connecting section 14, 14' are integrally coupled to make the manufacturing of the choke coil much easier and greatly lower the manufacturing cost.

What is claimed is:

1. A connecting structure of choke coil, comprising:

a coil base, composed of two halves;

an accommodating area disposed within said two halves;

a coiling area disposed outside said two halves;

a pair of corresponding connecting sections, each extending parallel to a plane between the two halves and extending from a first solid section on both sides of said coiling area; thereby said coil base being installed onto a housing and insulated with said housing to prevent a high-voltage electric leakage and comply with a high-voltage electric leakage test.

2. The connecting structure of choke coil of claim 1, wherein said connecting section has a hole.

3. The connecting structure of choke coil of claim 1, having a second solid section on both sides of the accommodating area and at least one reinforced rib formed between the first solid section, the second solid section and the connecting section.

4. The connecting structure of choke coil of claim 3, wherein said reinforced rib has a connecting area.

5. The connecting structure of choke coil of claim 4, wherein said connecting area has a protrusion.

6. The connecting structure of choke coil of claim 4, wherein said connecting area has an opening and a blocking section at both ends of the opening.

7. The connecting structure of choke coil of claim 4, wherein said solid section of the connecting area has a buffer area corresponding to a restricting section.

8. The connecting structure of choke coil of claim 4, further comprising a coupling member disposed in said connecting area for structurally connecting said coil base to the housing.

9. The connecting structure of choke coil of claim 8, wherein said coupling member is polygonal and has threads inside.

10. The connecting structure of choke coil of claim 8, wherein said coupling member is integrally formed with said coil base by injection and wrapped in the interior of said coil base.

11. The connecting structure of choke coil of claim 8, wherein said coupling member comprises a restricting section and a coupling section, and said restricting section and coupling section each has threads at their internal edges.

12. The connecting structure of choke coil of claim 11, wherein said restricting section has a circumference larger than the circumference of said coupling section.

13. The connecting structure of choke coil of claim 1, further comprising a movable component has a threaded external surface.

* * * * *